US005709110A

United States Patent [19]

Greenfield et al.

[11] Patent Number: 5,709,110

[45] Date of Patent: Jan. 20, 1998

[54] SECURITY SYSTEM FOR A LAP-TOP COMPUTER

[76] Inventors: Jack Greenfield, 2 Irving St.; David Monoson, 1530 Coolidge Ave., both of Baldwin, N.Y. 11510

[21] Appl. No.: 726,630

[22] Filed: Oct. 7, 1996

[51] Int. Cl.[6] ..... E05B 73/00

[52] U.S. Cl. ..... 70/58; 70/18; 70/232; 70/DIG. 57; 248/553

[58] Field of Search ..... 70/58, 57, 61, 70/18, 30, 14, 49, 19, 232; 248/551, 553, 505

[56] References Cited

U.S. PATENT DOCUMENTS

| | | | |
|---|---|---|---|
| 3,605,460 | 9/1971 | Singer et al. | 70/49 |
| 3,664,163 | 5/1972 | Foote | 70/58 |
| 3,765,196 | 10/1973 | Balicki | 70/49 |
| 3,771,338 | 11/1973 | Raskin | 70/58 |
| 3,785,183 | 1/1974 | Sander | 70/58 |
| 3,859,826 | 1/1975 | Singer et al. | 70/58 |
| 3,866,873 | 2/1975 | Bohli | 248/205 A |
| 4,055,973 | 11/1977 | Best | 70/18 |
| 4,236,395 | 12/1980 | Avaiusini | 70/19 |
| 4,300,371 | 11/1981 | Herwick et al. | 70/58 |
| 4,448,049 | 5/1984 | Murray | 70/58 |
| 4,570,465 | 2/1986 | Bennett | 70/18 |
| 4,811,577 | 3/1989 | Webster et al. | 70/49 |
| 4,842,912 | 6/1989 | Hunter, III | 248/205.3 |
| 4,970,882 | 11/1990 | Arrendondo | 70/30 |
| 5,050,836 | 9/1991 | Makous | 70/58 |
| 5,076,079 | 12/1991 | Monoson et al. | 70/58 |
| 5,197,706 | 3/1993 | Braithwaite et al. | 70/58 |
| 5,327,752 | 7/1994 | Myers et al. | 70/57 |
| 5,349,834 | 9/1994 | Davidge | 70/18 |
| 5,361,610 | 11/1994 | Sanders | 70/14 |
| 5,381,685 | 1/1995 | Carl et al. | 70/57 |
| 5,447,045 | 9/1995 | Cheng | 70/58 |
| 5,568,740 | 10/1996 | Lin | 70/49 |

OTHER PUBLICATIONS

Popular Science, Sep. 1984 "What's New in Electronics", p. 92.

*Primary Examiner*—Darnell M. Boucher
*Attorney, Agent, or Firm*—Michael I. Kroll

[57] ABSTRACT

A security system (28) for a lap-top computer (30) with a monitor housing (32) hinged thereto. The system (28) comprises a low profile mounting plate (34). A component (36) is for affixing the low profile mounting plate (34) to the monitor housing (32). An elongated flexible retainment cable (38) is provided. A first assembly (40) is for locking in a swiveled manner, a first end of the cable (38) to a table/counter top (41). A second assembly (42) is for locking in a universal articulated manner a second end of the cable (38) to the low profile mounting plate (34). The monitor housing (32) of the lap-top computer (30) can be moved from a closed position to a vertical opened position, without interference from the cable (38) for full freedom of movement and positioning thereof.

16 Claims, 7 Drawing Sheets

96

28
32
34
36
38
40
41
42
44
46
48
50
52
54
58
62
64
66
68
70
72
74
76
78
82
84
86
88
90
92

SECURITY SYSTEM FOR A LAP-TOP COMPUTER

BACKGROUND OF THE INVENTION

1. Field of the Invention

The instant invention relates generally to theft prevention devices and more specifically it relates to a security system for a lap-top computer.

2. Description of the Prior Art

Numerous theft prevention devices have been provided in prior art that are adapted to safeguard all types of equipment in a way that makes them nearly impossible to steal. While these units may be suitable for the particular purpose to which they address, they would not be as suitable for the purposes of the present invention as heretofore described.

SUMMARY OF THE INVENTION

A primary object of the present invention is to provide a security system for a lap-top computer and any other similar equipment, that will overcome the shortcomings of the prior art devices.

Another object is to provide a security system for a lap-top computer that will prevent the unauthorized removal of the lap-top computer, when left unattended and permits use of the lap-top computer when in a secured mode, since the flexible retainment cable will not interfere with the operation of the lap-top computer.

An additional object is to provide a security system for a lap-top computer, in which a low profile mounting plate connected to the equipment will produce a compact unobtrusive anchor for a lock cylinder on a universal articulated cable end on the flexible retainment cable for full freedom of movement and positioning thereof.

A further object is to provide a security system for a lap-top computer that is simple and easy to use.

A still further object is to provide a security system for a lap-top computer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
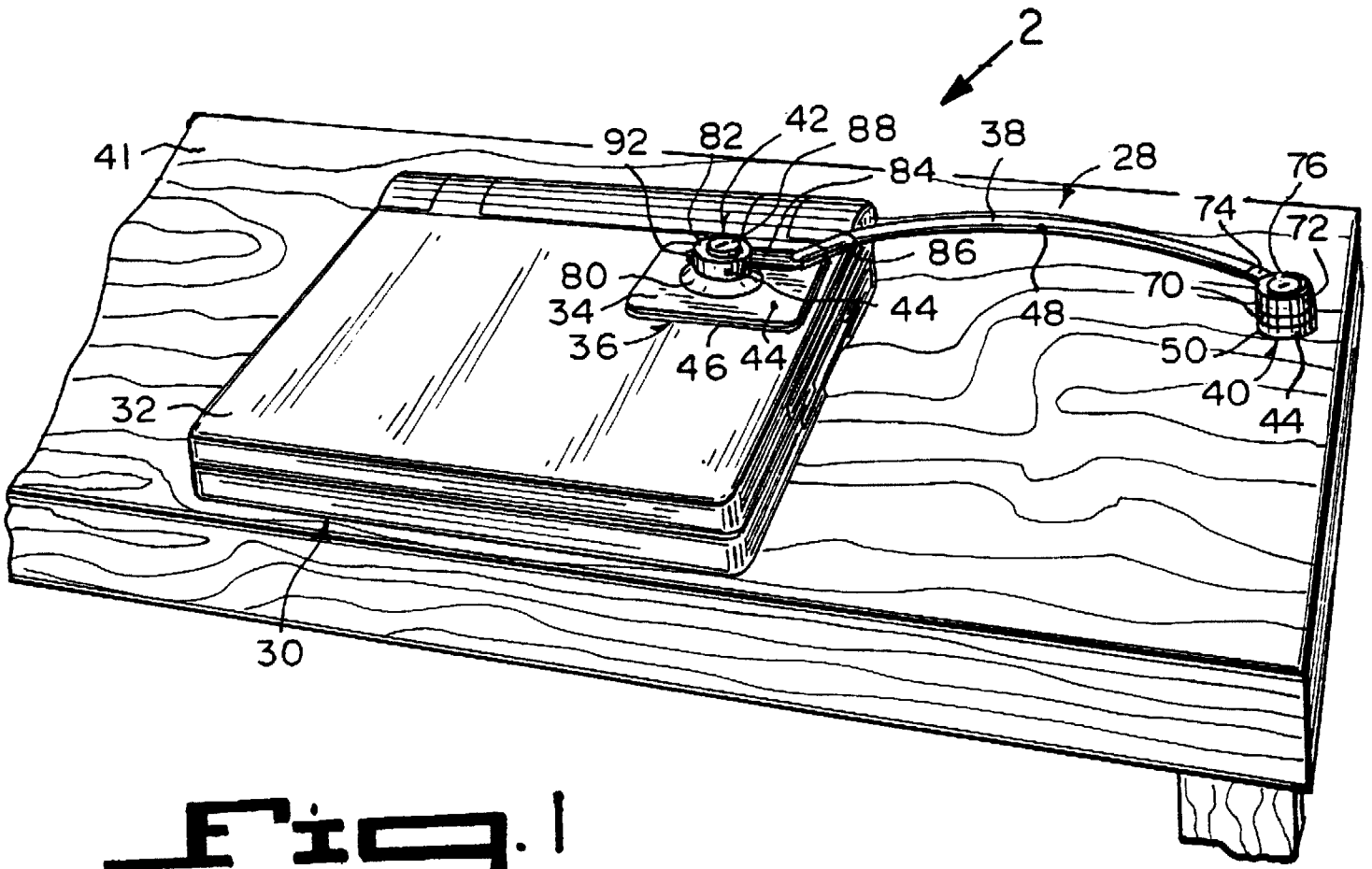
FIG. 1 is a perspective view of the instant invention mounted between a monitor housing of a lap-top computer in a closed position and a table/counter top.
Figure 2:
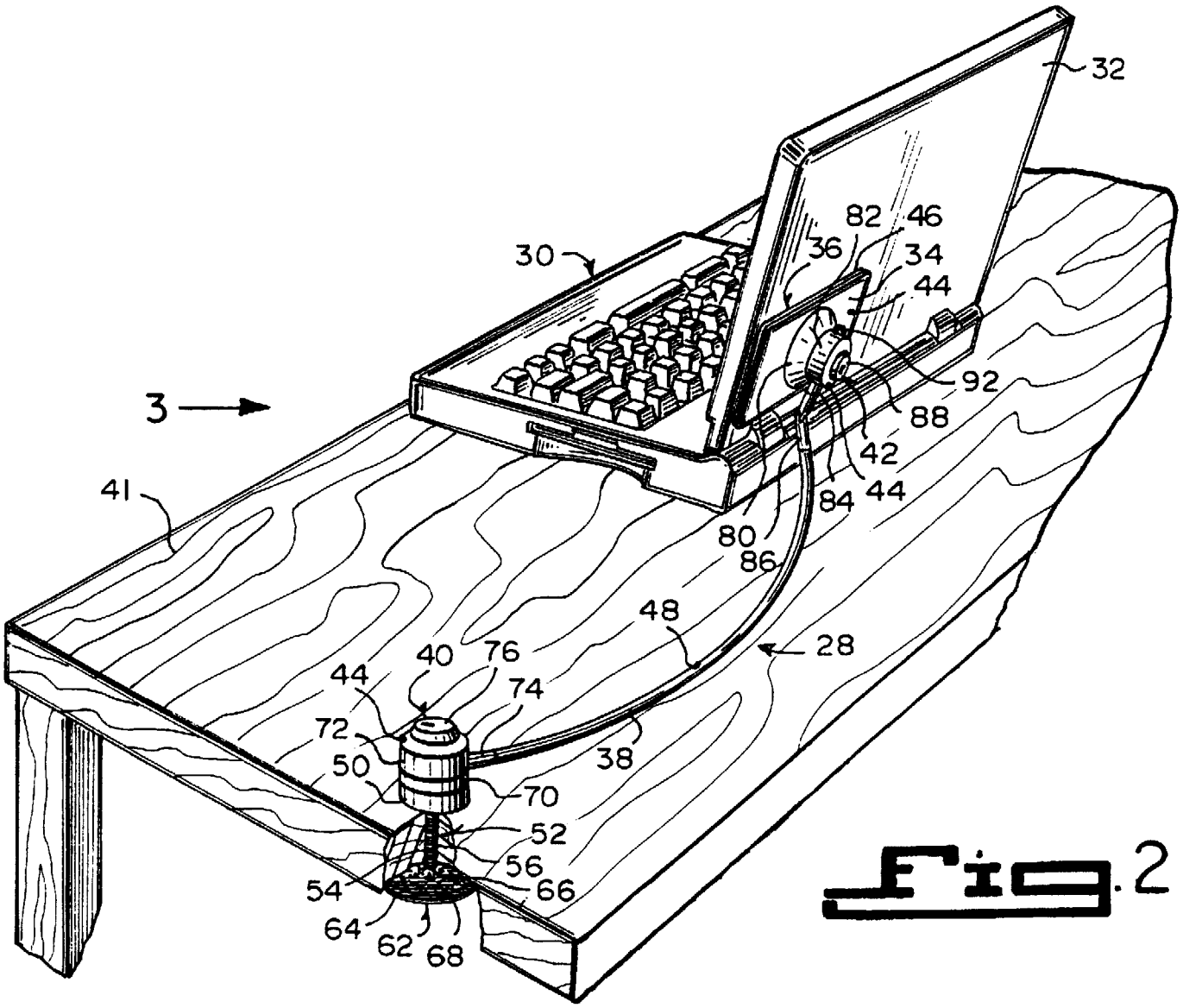
FIG. 2 is a perspective view taken in the direction of arrow 2 in FIG. 1, with the monitor housing in an opened position and the lap-top computer ready for use.

Turning now descriptively to the drawings, in which similar reference characters denote similar elements throughout the several views, FIGS. 1 through 9, illustrate a security system 28 for a lap-top computer 30 with a monitor housing 32 hinged thereto. The system 28 comprises a low profile mounting plate 34. A component 36 is for affixing the low profile mounting plate 34 to the monitor housing 32. An elongated flexible retainment cable 38 is provided. A first assembly 40 is for locking in a swiveled manner, a first end of the cable 38 to a table/counter top 41. A second assembly 42 is for locking in a universal articulated manner, a second end of the cable 38 to the low profile mounting plate 34. The monitor housing 32 of the lap-top computer 30 can be moved from a closed position to a vertical opened position, without interference from the cable 38 for full freedom of movement and positioning thereof.

The mounting plate 34 is fabricated out of a strong durable material 44. The affixing component 36 is specially reinforced cyanoacrylate bonding adhesive 46 applied onto an underside of the low profile mounting plate 34. The adhesive 46 will firmly stick to the monitor housing 32. The adhering technique for attaching the mounting plate 34 to the monitoring housing 32 is as follows:

(1) The underside of the mounting plate 34 is treated with the specially reinforced cyanoacrylate bonding adhesive 46 and is immediately installed in place. The surface of the monitor housing 32 is prepared in advance by removing any waxes or silicone mold release compounds with isoprophyl alcohol.

(2) An alternate method of attachment is with use of a high density rubber substrate pressure sensitive adhesive on surfaces prepared with an acrylic sealer.

Figure 9:
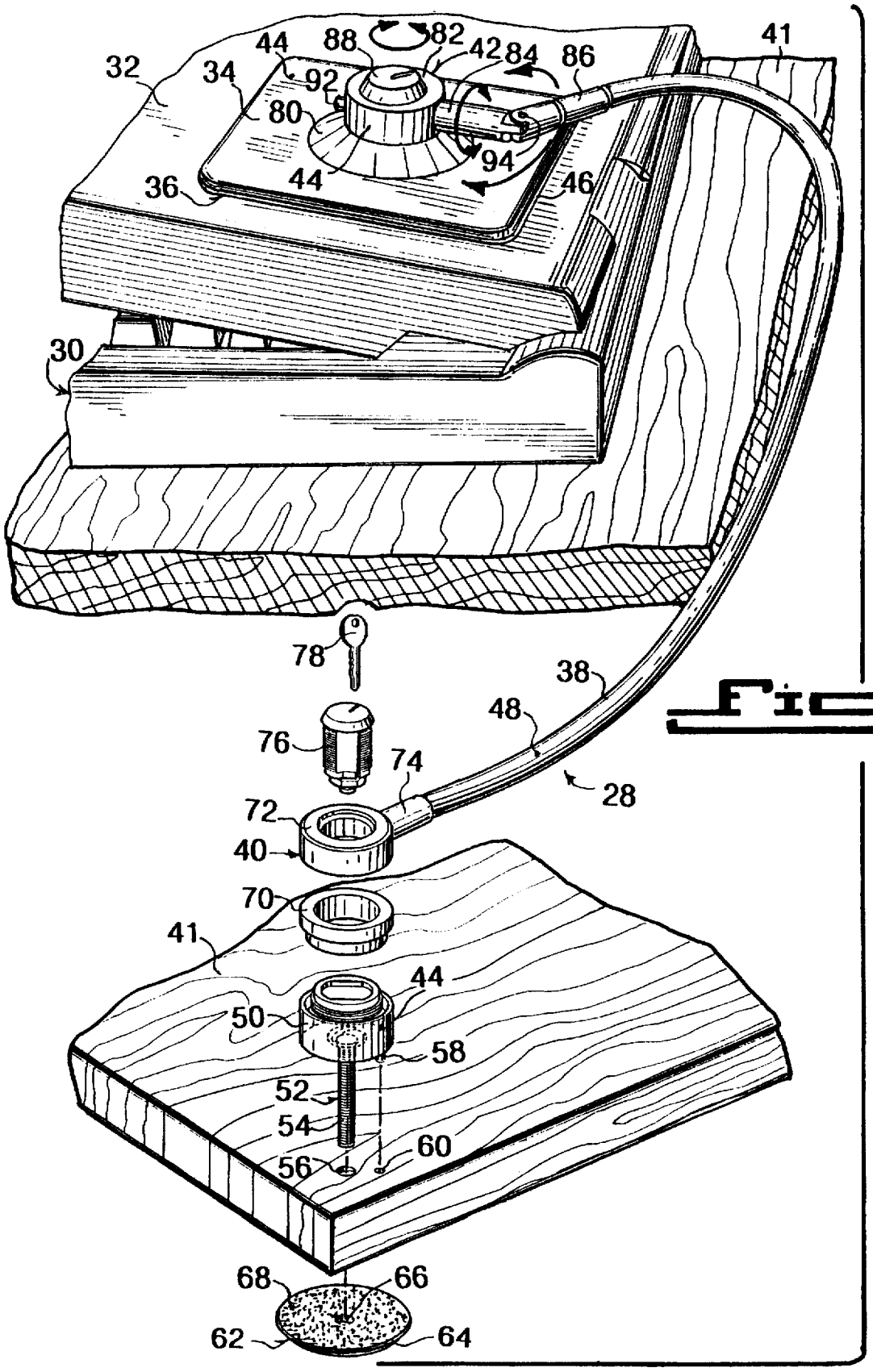
FIG. 9 is a perspective view with parts broken away and exploded, to show the various components for mounting the first locking assembly onto the table/counter top.

The cable 38 is fabricated out of a heavy duty special material 48, which resists cutting and sawing by most conventional tools. The first locking assembly 40, as best seen in FIG. 9, includes a lock base 50. A pan head bolt 52 having a threaded shank 54 extends centrally from a bottom end of the lock base 50 and through a hole 56 in the table/counter top 41. An anti-spin pin 58 extends off center from the bottom end of the lock base 50 and into an anti-spin hole 60 in the table/counter top 41. A disc nut 62 has a chamfered edge 64 and a centrally threaded aperture 66, to engage with the threaded shank 54 of the pan head bolt 52. A pressure sensitive acrylic adhesive substrate 68 is applied onto a top side of the disc nut 62. When the centrally threaded aperture 66 of the disc nut 62 is tightly threaded onto the threaded shank 54 of the pan head bolt 52, the adhesive substrate 68 will firmly stick to the underside of the table/counter top 41. The adhesive substrate 68 is resilient and will absorb shock of any attempt to loosen the disc nut 62 with a hammer and chisel.

An adaptor ring 70 fits onto the lock base 50. A first cable collar 72 is provided. A swivel sleeve 74 is on the first cable collar 72 and is attached to the first end of the cable 38. A first lock cylinder 76 fits through the first cable collar 72, the adaptor ring 70 and into the lock base 50. A first key 78 is inserted into the first lock cylinder 76. The first key 78 will lock the first lock cylinder 76 in the lock base 50, to allow the first cable collar 72 to revolve three hundred and sixty degrees around the first lock cylinder 76, (see double arrow A in FIG. 4) and the swivel sleeve 74 with the first end of the cable 38 turning three hundred and sixty degrees on its axis, (see double arrow B in FIG. 4). The first locking assembly 40 is fabricated out of the strong durable material 44.

The second locking assembly 42 consists of the low profile locking plate 34 having an integral compact unobtrusive anchor socket 80. A second cable collar 82 is permanently attached to a swivel member 84 and held thereto by two blind pins. The cable 38 has its second end affixed with the second cable collar 82. The first end of the cable 38 has affixed thereto the first cable collar 72, while affixed within the first cable collar 72 is the first locking assembly 40. The second locking assembly 42, which attaches to the mounting plate 34 on the monitor housing 32, when in the unlocked position, is not removable without using special tools. The first locking assembly 40 at the first end of the cable 38, which attaches to the table/counter top 41 is removable. The reason for this is that the second locking assembly 42, when unlocked, would not be lost when the cable 38 is removed from the lap-top computer 30.

A knuckle joint 86 has a first end integral with the swivel member 84 and a second end attached to the second end of the cable 38. A second lock cylinder 88 fits through the second cable collar 82 and into the anchor socket 80. A second key 90 is inserted into the second lock cylinder 88. The second key 90 will lock the second lock cylinder 88 in the anchor socket 80, to allow the second cable collar 82 to revolve three hundred and sixty degrees about the second lock cylinder 88 (see double arrow C in FIG. 5). The swivel member 84 will turn three hundred and sixty degrees on its axis (see double arrow D in FIG. 5), and the knuckle joint 86 with the second end of the cable 38 will swing one hundred seventy degrees in one plane (see double arrow E in FIG. 5).

A hold button 92 is in the second cable collar 82. When the hold button 92 is depressed, it will retain the second lock cylinder 88 and prevent it from rotating within the second cable collar 82, so that the second key 90 can be operated between an open or closed cam position. The knuckle joint 86 includes a knurled blind assembly pin 94 to resist tampering thereof. The second locking assembly 42 is also fabricated out of the strong durable material 44.

Figures 3, 10:
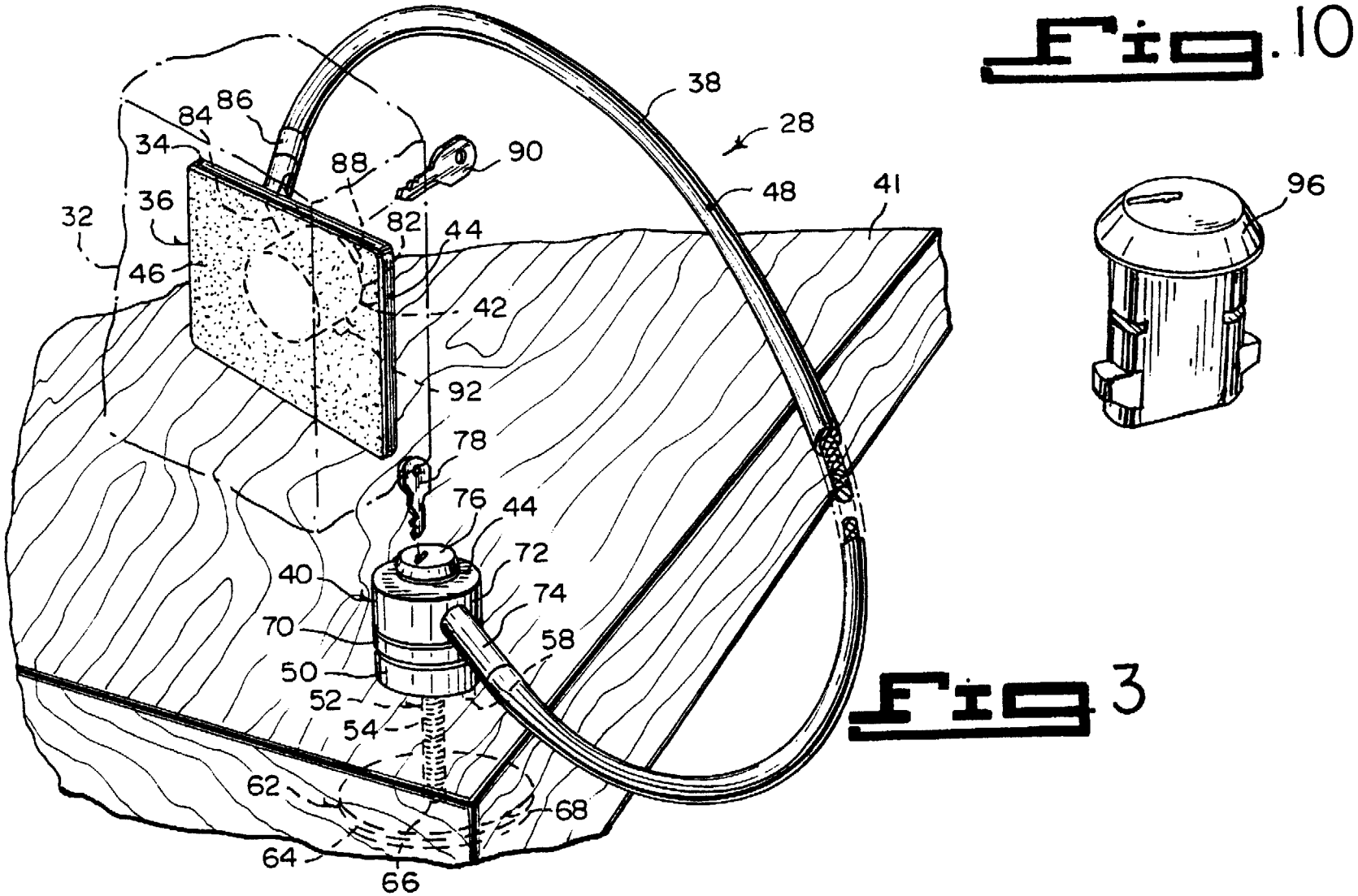
FIG. 3 is a perspective view taken in the direction of arrow 3 in FIG. 2, with part of the monitor housing shown in phantom and the cable broken away.
FIG. 10 is a perspective view of an alternate lock cylinder.
Figure 4:
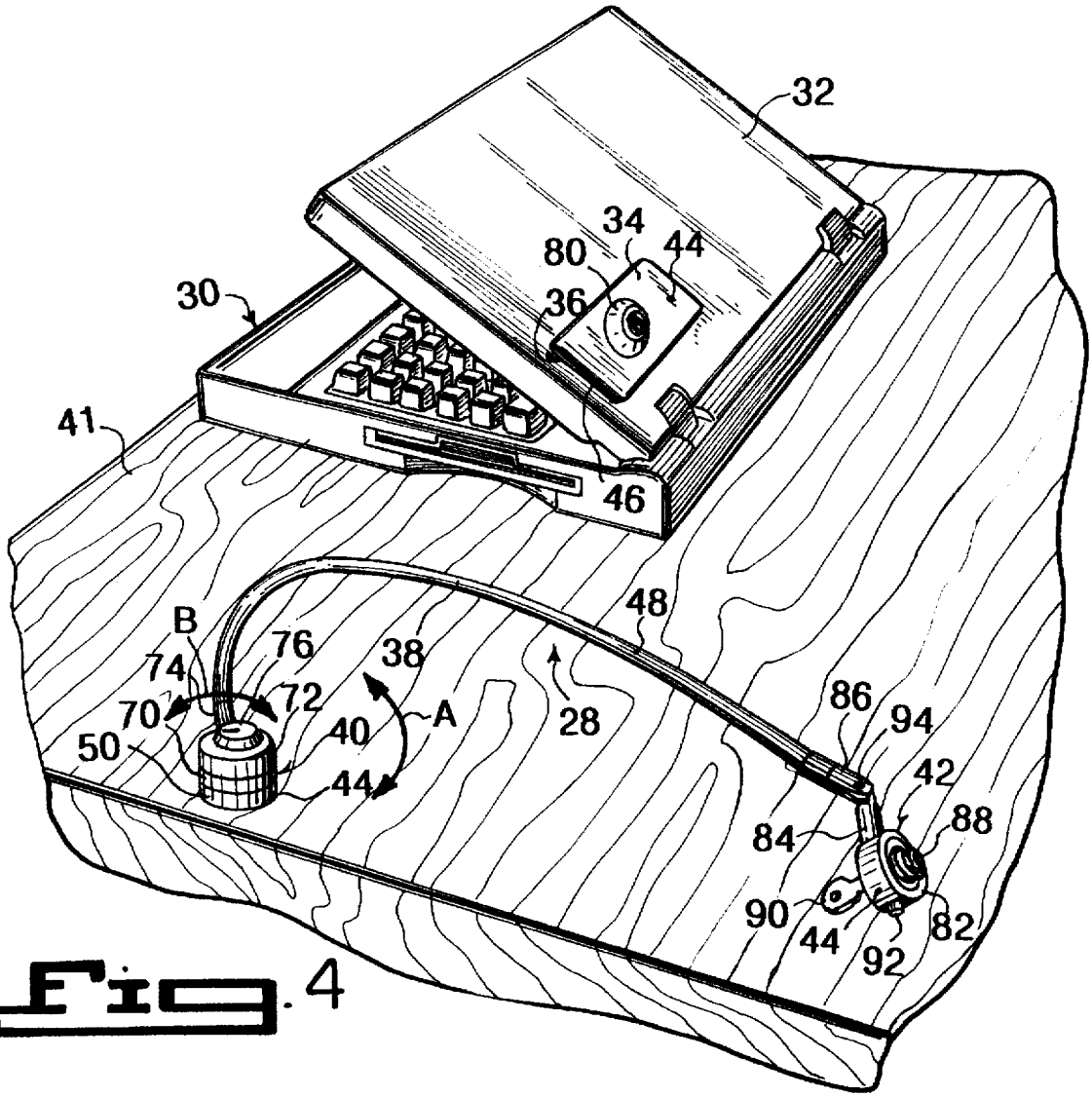
FIG. 4 is a perspective view similar to FIG. 2, with the second lock cylinder in the second lock assembly end of the cable disengaged from the integral compact unobtrusive anchor socket of the low profile mounting plate, with the monitor housing going into the closed position.
Figure 5:
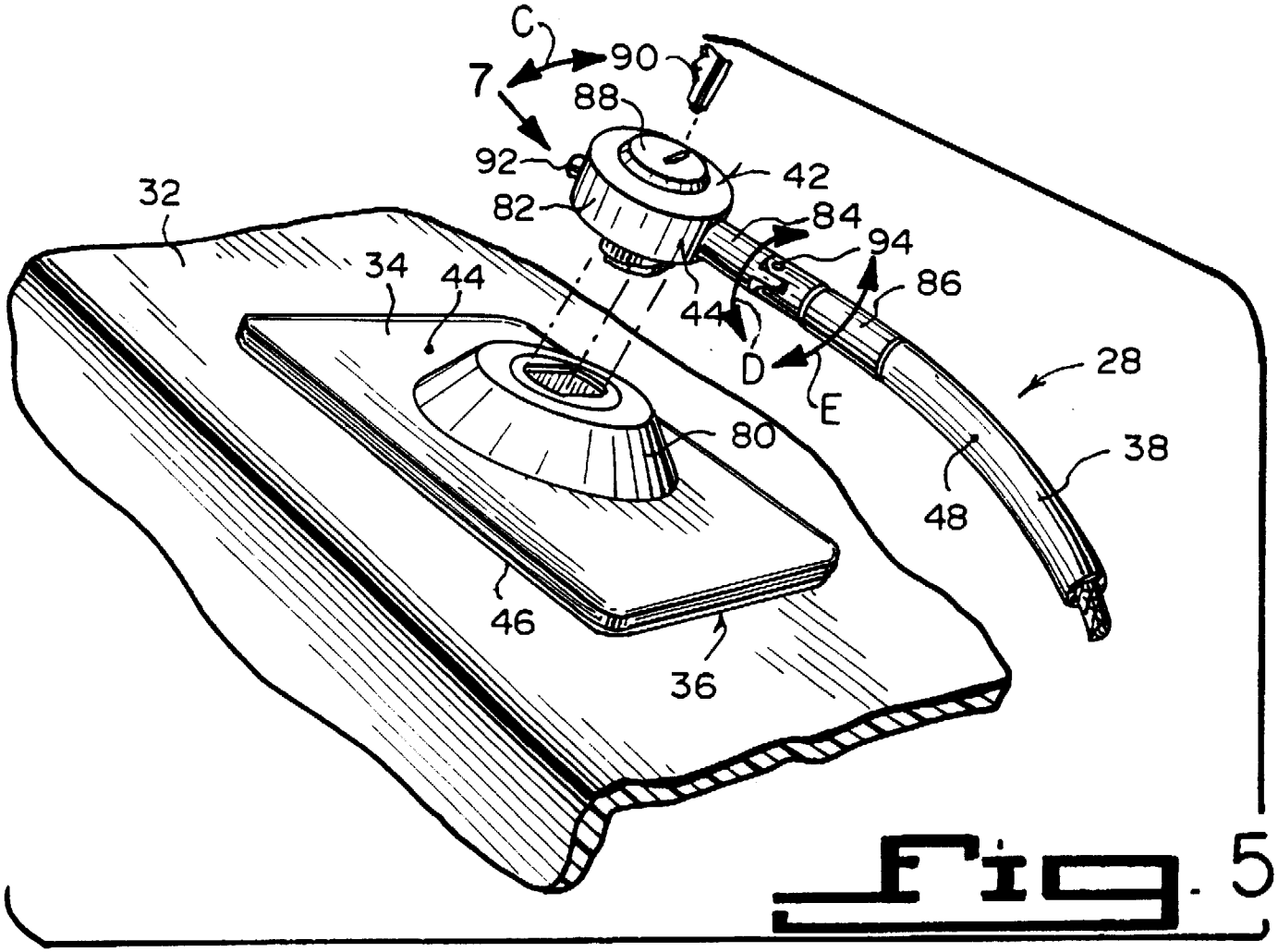
FIG. 5 is a perspective view, showing the second lock cylinder in the second lock assembly at the second end of the cable ready to be inserted into the integral compact unobtrusive anchor socket of the low profile mounting plate on the monitor housing.
Figure 6:
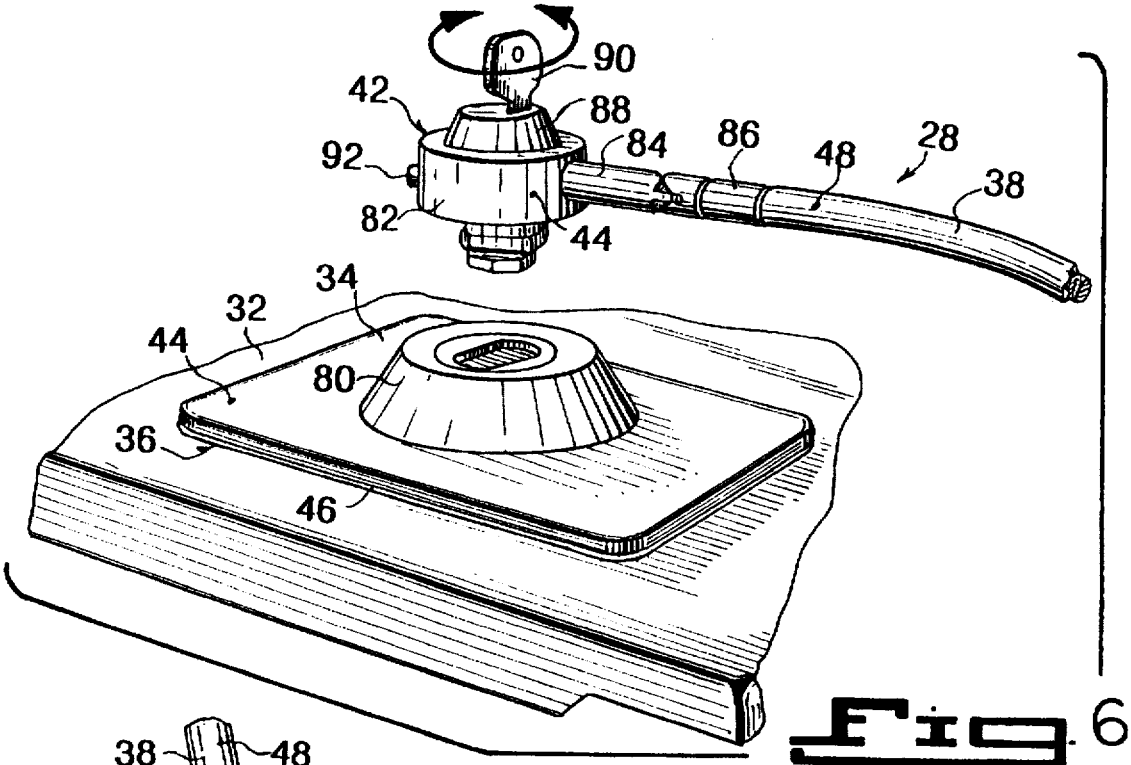
FIG. 6 is a perspective view similar to FIG. 5, with the second key inserted into the second lock cylinder.
Figure 7:
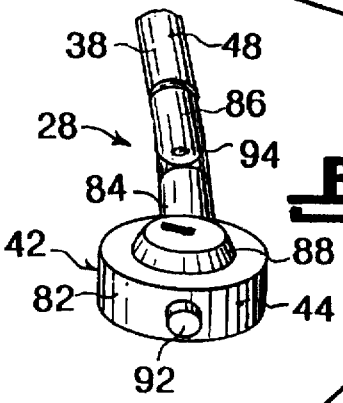
FIG. 7 is a perspective view taken in the direction of arrow 7 in FIG. 5.
Figure 8:
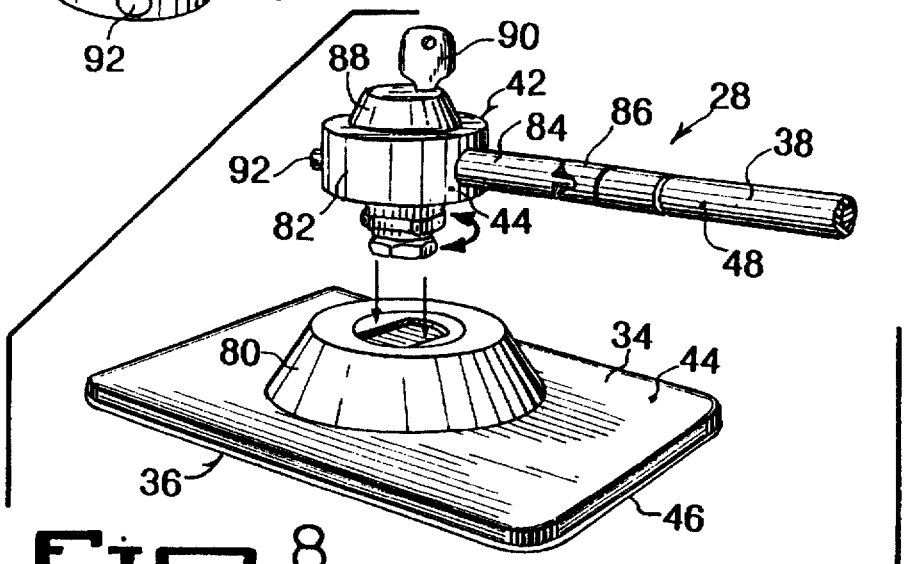
FIG. 8 is a perspective view similar to FIG. 6, with the monitor housing removed therefrom.

The first lock cylinder 76 and the second lock cylinder 88 can be of identical construction. The first key 78 and the second key 90 can also be identical, so that one key can operate both of the lock cylinders 76 and 88. In FIG. 10, an alternate lock cylinder 96 is shown, which can be substituted for the first and second lock cylinders 76 and 88.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A security system for securing a lap-top computer having a monitor housing hinged thereto to a table/counter top having a hole therethrough, said system comprising:

a) a low profile mounting plate;

b) means for affixing said low profile mounting plate to the monitor housing;

c) an elongated flexible retainment cable;

d) first locking means for locking in a swiveled manner, a first end of said cable to the table/counter top, said first locking means including:

i) lock base;

ii) a pan head bolt having a threaded shank extending centrally from a bottom end of said lock base and through the hole in the table/counter top;

iii) an anti-spin pin extending off center from the bottom end of said lock base and into an anti-spin hole in the table/counter top;

iv) a disc nut having a chamfered edge and a centrally threaded aperture to engage with said threaded shank of said pan head bolt;

v) a pressure sensitive acrylic adhesive substrate applied onto a top side of said disc nut, whereby when said centrally threaded aperture of said disc nut is tightly threaded onto said threaded shank of said pan head bolt, said adhesive substrate will firmly stick to the underside of the table/counter top;

vi) an adaptor ring to fit onto said lock base;

vii) a first cable collar;

viii) a swivel sleeve on said first cable collar and attached to said first end of said cable;

ix) a first lock cylinder which fits through said first cable collar, said adaptor ring and into said lock base; and x) a first key to be inserted into said first lock cylinder, whereby said first key will lock said first lock cylinder in said lock base, to allow said first cable collar to revolve three hundred and sixty degrees around said first lock cylinder and said swivel sleeve, with said first end of said cable turning three hundred and sixty degrees on its axis; and e) second locking means for locking in a universal articulated manner a second end of said cable to said low profile mounting plate, so that the monitor housing of the lap-top computer can be moved from a closed position to a vertical opened position, without interference from said cable for full freedom of movement and positioning thereof.

2. A security system as recited in claim 1, wherein said mounting plate is fabricated out of a strong durable steel material.

3. A security system as recited in claim 1, wherein said affixing means is a specially reinforced cyanoacrylate bonding adhesive applied onto an underside of said low profile mounting plate, whereby said adhesive will firmly stick to the monitor housing.

4. A security system as recited in claim 1, wherein said cable is fabricated out of a heavy duty special material, which resists cutting and sawing by most conventional tools.

5. A security system as recited in claim 1, wherein said first locking means is fabricated out of a strong durable material.

6. A security system as recited in claim 1, wherein said second locking mean includes:

a) said low profile locking plate having an integral compact unobtrusive anchor socket;

b) a second cable collar;

c) a swivel member permanently attached to said second cable collar;

d) a knuckle joint having a first end integral with said swivel member and a second end attached to the second end of said cable;

e) a second lock cylinder which fits through said second cable collar and into said anchor socket; and f) a second key to be inserted into said second lock cylinder, whereby said second key will lock said second lock cylinder in said anchor socket, to allow said second cable collar to revolve three hundred and sixty degrees about said second lock cylinder, said swivel member to turn three hundred and sixty degrees on its axis and said knuckle joint with the second end of said cable to swing one hundred seventy degrees in one plane.

7. A security system for securing a lap-top computer having a monitor housing hinged thereto to a table/counter top having a hole therethrough, said system comprising:

a) a low profile mounting plate;

b) means for affixing said low profile mounting plate to the monitor housing;

c) an elongated flexible retainment cable;

d) first locking means for locking in a swiveled manner, a first end of said cable to the table/counter top; and e) second locking means for locking in a universal articulated manner a second end of said cable to said low profile mounting plate, so that the monitor housing of the lap-top computer can be moved from a closed position to a vertical opened position, without interference from said cable for full freedom of movement and positioning thereof, said second locking means including:

i) said low profile locking plate having an integral compact unobtrusive anchor socket;

ii) a second cable collar;

iii) a swivel member permanently attached to said second cable collar;

iv) a knuckle joint having a first end integral with said swivel member and a second end attached to said second end of said cable;

v) a second lock cylinder which fits through said second cable collar and into said anchor socket;

vi) a second key to be inserted into said second lock cylinder, whereby said second key will lock said second lock cylinder in said anchor socket, to allow said second cable collar to revolve three hundred and sixty degrees about said second lock cylinder, said swivel member to turn three hundred and sixty degree on it axis and said knuckle joint with said second end of said cable to swing one hundred and seventy degrees in one plane; and vii) a hold button in said second cable collar, whereby when said hold button is depressed, it will retain said second lock cylinder and prevent it from rotating within said second cable collar, so that said key can be operated between an open and closed cam position.

8. A security system as recited in claim 6, wherein said knuckle joint includes a knurled blind assembly pin to resist tampering thereof.

9. A security system as recited in claim 1, wherein said second locking means is fabricated out of a strong durable material.

10. A security system as recited in claim 3, wherein said mounting plate is fabricated out of a strong durable material.

11. A security system as recited in claim 10, wherein said cable is fabricated out of a heavy duty special material, which resists cutting and sawing by most conventional tools.

12. A security system as recited in claim 11, wherein said first locking means is fabricated out of a strong durable material.

13. A security system as recited in claim 12, wherein said second locking means includes:

a) said low profile locking plate having an integral compact unobtrusive anchor socket;

b) a second cable collar;

c) a swivel member permanently attached to said second cable collar;

d) a knuckle joint having a first end integral with said swivel member and a second end attached to the second end of said cable;

e) a second lock cylinder which fits through said second cable collar and into said anchor socket; and f) a second key to be inserted into said second lock cylinder, whereby said second key will lock said second lock cylinder in said anchor socket, to allow said second cable collar to revolve three hundred and sixty degrees about said second lock cylinder, said swivel member to turn three hundred and sixty degrees on its axis and said knuckle joint with the second end of said cable to swing one hundred seventy degrees in one plane.

14. A security system as recited in claim 13, wherein said second locking means further includes a hold button in said second cable collar, whereby when said hold button is depressed, it will retain said second lock cylinder and prevent it from rotating within said second cable collar, so that said second key can be operated between an open and closed cam position.

15. A security system as recited in claim 14, wherein said knuckle joint includes a knurled blind assembly pin to resist tampering thereof.

16. A security system as recited in claim 15, wherein said second locking means is fabricated out of a strong durable material.

* * * * *